US007870668B2

(12) United States Patent
Hughes et al.

(10) Patent No.: US 7,870,668 B2
(45) Date of Patent: Jan. 18, 2011

(54) METHOD FOR CONNECTING AN ELECTRICAL CONNECTOR TO A CABLE CONNECTOR

(75) Inventors: David Charles Hughes, Rubicon, WI (US); John Mitchell Makal, Menomonee Falls, WI (US); Paul Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 19 days.

(21) Appl. No.: 12/355,291

(22) Filed: Jan. 16, 2009

(65) Prior Publication Data

US 2009/0124130 A1 May 14, 2009

Related U.S. Application Data

(62) Division of application No. 11/191,142, filed on Jul. 28, 2005, now Pat. No. 7,491,075.

(51) Int. Cl.
*H01R 43/20* (2006.01)

(52) U.S. Cl. ..... 29/876; 29/857; 439/805

(58) Field of Classification Search ..... 29/830, 29/857, 874, 876; 439/306, 727, 801, 805
See application file for complete search history.

(56) References Cited

U.S. PATENT DOCUMENTS

| | | | | |
|---|---|---|---|---|
| 2,397,097 | A * | 3/1946 | Forbes et al. | 439/727 |
| 4,186,985 | A * | 2/1980 | Stepniak et al. | 439/306 |
| 4,354,721 | A | 10/1982 | Luzzi | |
| 4,360,967 | A | 11/1982 | Luzzi et al. | |
| 4,715,104 | A | 12/1987 | Schoenwetter et al. | |
| 4,722,694 | A | 2/1988 | Makal et al. | |
| 4,779,341 | A | 10/1988 | Roscizewski | |
| 4,799,895 | A | 1/1989 | Borgstrom | |
| 4,857,021 | A | 8/1989 | Boliver et al. | |
| 5,525,069 | A | 6/1996 | Roscizewski et al. | |
| 6,042,407 | A | 3/2000 | Scull et al. | |
| 6,520,795 | B1 | 2/2003 | Jazowski | |

OTHER PUBLICATIONS

"Stick-OPerable 600-Amp Connector Systems," *Elastimold, Amerace Corporation*, Feb. 1984, 11 pages.

"Molded Rubber Products, 600 A 15 kV Class T-OP™ II Deadbreak Connector Electrical Apparatus 600-12," *Cooper Power Systems*, Jul. 2005, pp. 1-4.

"Molded Rubber Products, 600 A 15 and 25 kV Deadbreak Accessories, Tools, Replacement Parts Electrical Apparatus 600-46"; *Cooper Power Systems*, Jul. 1997, pp. 1-4.

"Molded Rubber Products, 600 A 25 kV Class BT-TAP™ Deadbreak Connector Electrical Apparatus 600-35," *Cooper Power Systems*, Mar. 2003, pp. 1-5.

"Deadbreak Apparatus Connectors, 600 A 15/25 kV Class Bol-T™ Deadbreak Connector Electrical Apparatus 600-10," *Cooper Power Systems*, Aug. 2002, 6 pages.

(Continued)

*Primary Examiner*—Donghai D. Nguyen
(74) *Attorney, Agent, or Firm*—Fish & Richardson P.C.

(57) ABSTRACT

An electrical connector includes a sleeve defining an axis and a contact assembly inserted in the sleeve, the contact assembly including pieces that move axially relative to one another during a fault close operation. An interface between the sleeve and the contact assembly is configured to permit replacement of the contact assembly without replacing the sleeve.

3 Claims, 7 Drawing Sheets

OTHER PUBLICATIONS

"Deadbreak Apparatus Connector, 600 A 25 kV Class Bushing Adapter for T-OP™ II Connector System (including LRTP and Bushing Extender) Electrical Apparatus 600-38," *Cooper Power Systems*, Jun. 1997, pp. 1-4.

"Loadbreak Apparatus Connectors, 200 A 15 kV Class Loadbreak Bushing Insert 500-12," *Cooper Power Systems*, Nov. 1995, pp. 1-2.

"T-OP™ II: How Many Sticks Does It Take To Operate Your 600 Amp Terminator System?," *Cooper Power Systems*, Jul. 1994, 4 pages.

Photograph of a BT-Tap, a retro fit version of the T-OPII LRTP shown in U.S. Patent No. 4,857,021, produced and sold by Cooper Power Systems prior to Jul. 28, 2005.

Photograph of an LRTP produced and sold by Elastimold prior to Jul. 28, 2005.

PCT International Search Report (PCT/US 06/29228) filed Jul. 28, 2006, 3 total pages.

PCT Written Opinion (PCT/US 06/29228) filed Jul. 28, 2006, 8 total pages.

Examination Report for corresponding Australian Application No. 2006275790, mailed Dec. 3, 2009, 3 pages.

* cited by examiner

METHOD FOR CONNECTING AN ELECTRICAL CONNECTOR TO A CABLE CONNECTOR

CROSS-REFERENCE TO RELATED APPLICATIONS

This application is a divisional (and claims the benefit of priority under 35 U.S.C. §121) of U.S. application Ser. No. 11/191,142, filed Jul. 28, 2005, now U.S. Pat. No. 7,491,075, titled ELECTRICAL CONNECTOR. The disclosure of the prior application is considered part of (and is incorporated by reference in) the disclosure of this application.

TECHNICAL FIELD

This description relates to an electrical connector for use under high-voltage conditions.

BACKGROUND

Electrical connectors are used to connect electrical transmission and distribution equipment within a distribution system.

SUMMARY

In one general aspect, an electrical connector includes a sleeve defining an axis and a contact assembly inserted in the sleeve, the contact assembly including pieces that move axially relative to one another during a fault close operation. An interface between the sleeve and the contact assembly is configured to permit replacement of the contact assembly without replacing the sleeve.

Implementations may include one or more of the following features. For example, the contact assembly may be configured to handle voltages of 15 kV or more during normal operation. The sleeve of the electrical connector may be made from a conductive material. The electrical connector may also include an insulating housing coaxial with and surrounding the sleeve. The insulating housing may also include a conductive shell that surrounds the insulating housing.

The contact assembly of the electrical connector may include a female contact within the sleeve that receives a male contact of a contact connector and an arc snuffer adjacent to the female contact. The contact assembly may also include a contact holder within the sleeve that receives the female contact. The female contact may include a piston region that intimately engages an inner surface of the contact holder. The contact holder may include a piston stop region having an inner diameter smaller than an outer diameter of the piston region.

In another general aspect, a contact assembly of an electrical connector that is received within a sleeve defining an axis may be replaced. The contact assembly is configured to receive a male contact of a contact connector and includes one or more components that move along the axis of the sleeve to engage the male contact during a fault close operation. To replace the contact assembly, a torque device is applied to a torque-enabling feature of the contact assembly. Force is applied to the torque device to move the contact assembly axially relative to the sleeve to remove the contact assembly from the sleeve.

Implementations may include one or more of the following features. For example, a replacement contact assembly may be inserted into the sleeve, and the torque device may be inserted through the replacement contact assembly and into a torque-enabling feature defined by the replacement contact assembly. Force then is applied to the torque device to move the replacement contact assembly axially relative to the sleeve to insert the replacement contact assembly into the sleeve. The replacement contact assembly may include a female contact within the sleeve that is configured to receive the male contact of a contact connector and an arc snuffer adjacent to the female contact.

In another general aspect, an electrical connector for use in a high power circuit includes an insulating housing defining an axis, a conductive sleeve within the housing and extending along the axis, a contact assembly slidably and axially received in the sleeve and configured to receive a male contact of a contact connector, a torque-enabling opening defined by the sleeve, and a torque-enabling feature defined by the contact assembly.

Implementations may include one or more of the following features. The contact assembly of the electrical connector may include a female contact within the sleeve that receives the male contact and an arc snuffer adjacent to the female contact. The contact assembly may also include a contact holder that defines the torque-enabling feature and receives the female contact. The female contact may include a piston region that intimately engages an inner surface of the contact holder. The contact holder may include a piston stop region having an inner diameter smaller than the outer diameter of the piston region. The contact holder may define a cavity between the piston region and the torque-enabling feature. The cavity may include openings extending from the cavity to an exterior of the contact holder. The contact holder may include an external surface that intimately engages an internal surface of the conductive sleeve.

The torque-enabling feature may have a larger diameter than the torque-enabling opening. The torque-enabling opening may be defined by the sleeve and disposed within the sleeve.

The electrical connector may also include a conductive shell that surrounds the insulated housing.

The torque-enabling feature may have a polygonal cross section. The torque-enabling feature may have an octagonal cross section. The torque-enabling opening may have a polygonal cross section.

In another general aspect, an electrical apparatus includes an electrical connector having a first insulating housing and a sleeve within the first insulating housing, the sleeve defining a threaded bore open to an end of the electrical connector, a cable connector having a second insulated housing, and a threaded stud positioned within the cable connector, in which the stud is sufficiently long and the threaded bore is sufficiently deep such that external threads of the stud engage the threaded bore of the electrical connector before the first insulating housing touches the second insulated housing.

Implementations may include one or more of the following features. The electrical connector may lack a threaded portion external to the insulating housing of the electrical connector. The sleeve of the electrical apparatus may be made from a conductive material. The electrical apparatus may also include a conductive shell that surrounds the first insulating housing.

In another general aspect, an electrical connector is connected to a cable connector. An electrical connector having a first insulating housing and a sleeve within the first insulating housing defining a threaded bore opening to an end of the electrical connector is provided, a cable connector having a second insulating housing is provided, a stud is provided within the cable connector, and the electrical connector is inserted into the cable connector such that external threads of the stud engage the threaded bore of the electrical connector before the first insulating housing of the electrical connector contacts the second insulating housing of the cable connector.

Implementations may include one or more of the following features. The electrical connector may be connected to the cable connector by securing the stud to the threaded bore. The stud may be secured to the threaded bore using a torque device that is inserted into a torque feature defined by the sleeve of the first connector and connected to the threaded bore of the electrical connector. Inserting the electrical connector into the cable connector may include inserting without the use of a coupling portion that extends from the sleeve of the first electrical connector.

In another general aspect, and electrical connector includes an insulating housing defining an axis, a contact assembly within the insulating housing and extending along the axis, and a unitary conductive sleeve extending along the axis from a first end within the housing to a second end that is void of the contact assembly and that defines a threaded bore that opens into a region external of the insulating housing, in which the unitary conductive sleeve defines a cavity between the first and second ends that receives the contact assembly.

Implementations may include one or more of the following features. The unitary conductive sleeve may act to reduce corona discharges within the contact assembly.

The electrical connector may also include a conductive shell that surrounds the insulating housing.

The contact assembly of the electrical connector may include a female contact within the unitary sleeve that receives a male contact of an external electrical device and an arc snuffer adjacent to the female contact.

The electrical connector may also include a torque-enabling opening defined by the unitary sleeve and a torque-enabling feature defined by the contact assembly. The contact assembly of the electrical connector may also include a contact holder that defines the torque-enabling feature and receives the female contact.

Aspects of the electrical connector can include one or more of the following advantages. For example, a unitary sleeve allows for more efficient operation of electrical connector because there are fewer current interchanges as compared to a sleeve made from multiple pieces. Moreover, a unitary sleeve results in a simpler design, thus allowing less expensive manufacturing.

The electrical connector does not require an external threaded portion to connect to the cable connector (that is, a T-shaped connector). Instead, the length of the stud enables the stud to engage the internal threaded bore of the electrical connector prior to the housing of the electrical connector touching the housing of the cable connector, which can hinder insertion of the electrical connector to the cable connector. This facilitates insertion of the electrical connector into the cable connector.

Other features will be apparent from the following description, including the drawings, and the claims.

DESCRIPTION OF DRAWINGS

Like reference symbols in the various drawings may indicate like elements.

DETAILED DESCRIPTION

Figure 1A:
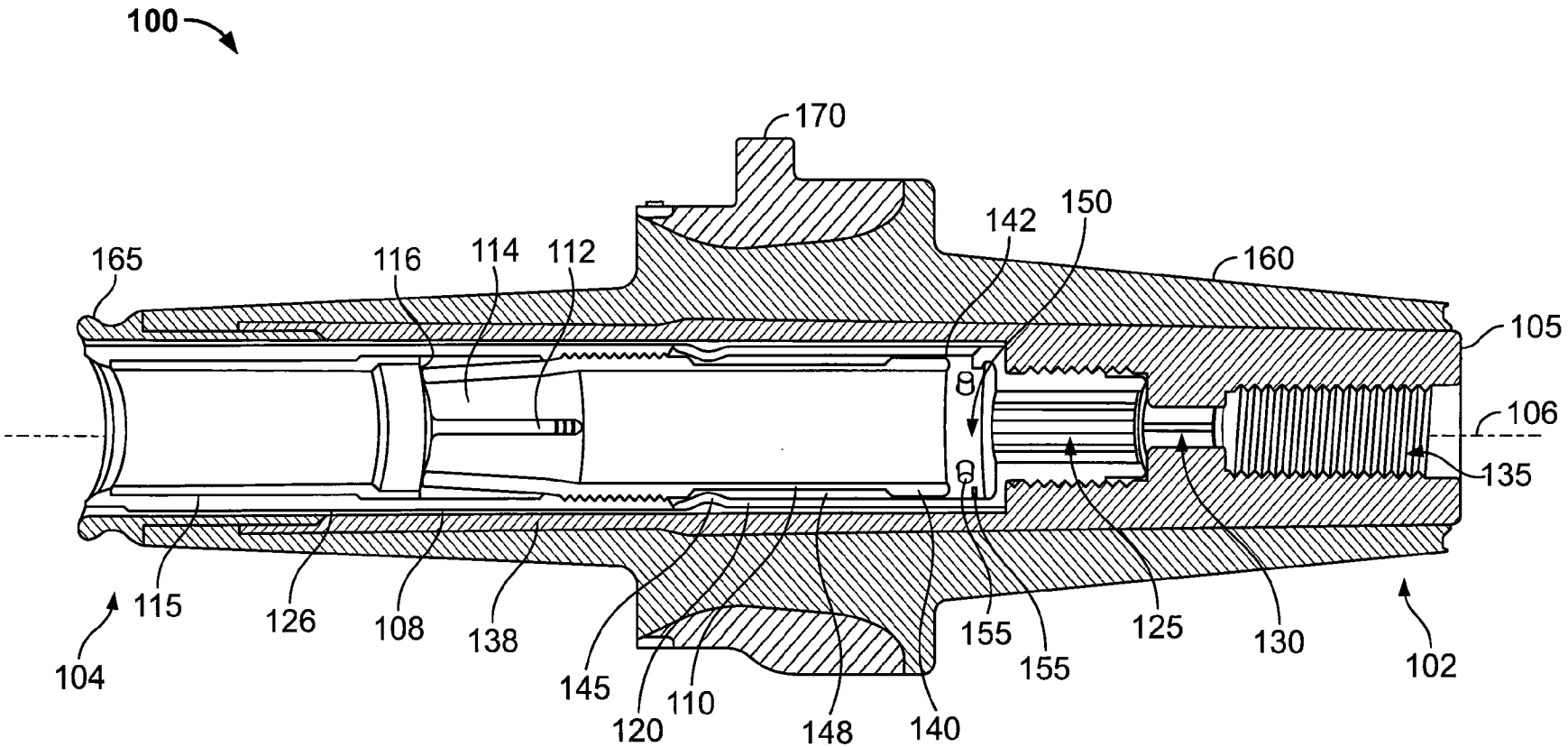
FIG. 1A is a side cross-sectional view of an electrical connector.

Referring to FIG. 1A, an electrical connector 100 is used in those situations in which it is desirable to reuse the electrical connector 100 after a fault close operation in a high-power circuit. In general, the electrical connector 100 is connected at a first region 102 to another electrical device (not shown), such as a transformer connected to a portion of a high-voltage circuit, and at a second region 104 to a contact connector (not shown), such as an elbow connector, that is connected to another portion of the high-voltage circuit.

The electrical connector 100 includes a unitary sleeve 105 that defines an axis 106 within the connector 100. The sleeve 105 is made of a conductive material, such as copper or aluminum. The sleeve 105 provides structure within the electrical connector 100. The sleeve 105 is maintained at the system voltage (for example, 15 or 25 kV) and acts as a Faraday cage to electrically shield a contact assembly 108 located within the sleeve 105.

Figure 1B:
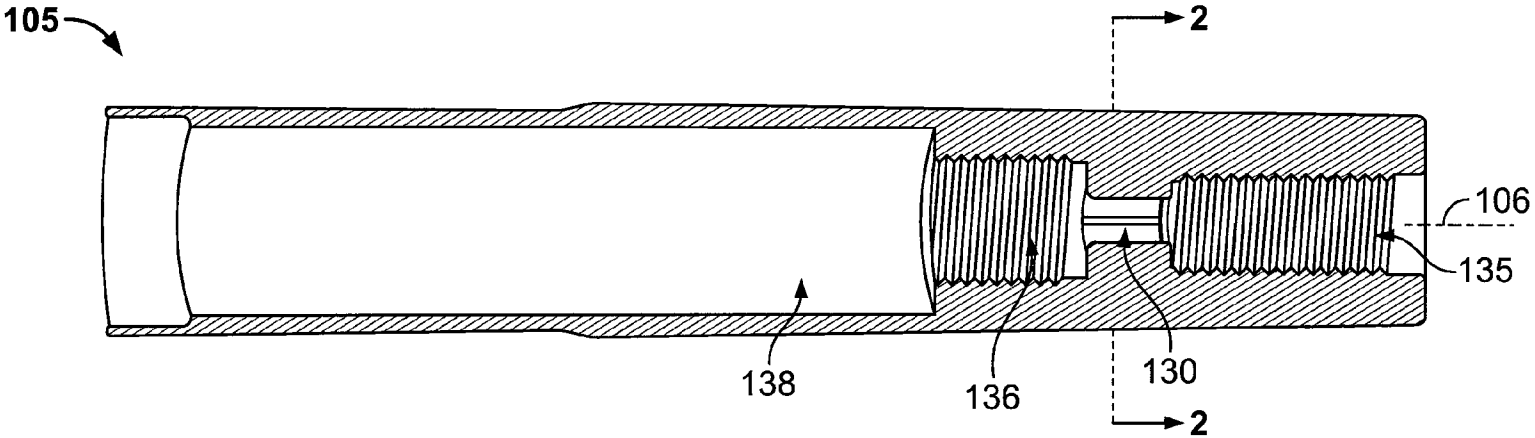
FIG. 1B is a side cross-sectional view of a sleeve within the electrical connector of FIG. 1A.
Figure 2:
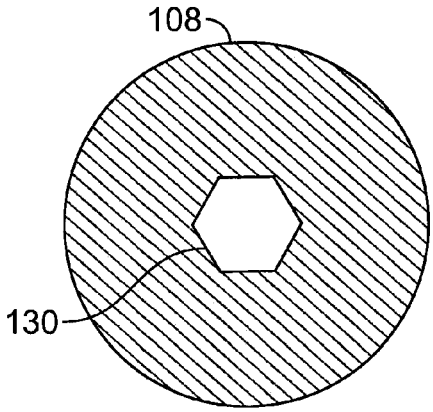
FIG. 2 is a cross-sectional view taken along line 2-2 of FIG. 1B.

Referring also to FIG. 1B, the sleeve 105 defines a threaded bore 135, a torque-enabling opening 130 adjacent the bore 135, a threaded region 136 adjacent the opening 130, and an elongated channel 138 adjacent the threaded region 136. The threaded bore 135 opens to receive a stud of the other electrical device. Referring to FIG. 2, the torque-enabling opening 130 has a hexagonal cross-section to receive a hexagonally shaped torque driver. In one implementation, the opening is 5/16 inches in cross section.

Figure 1C:
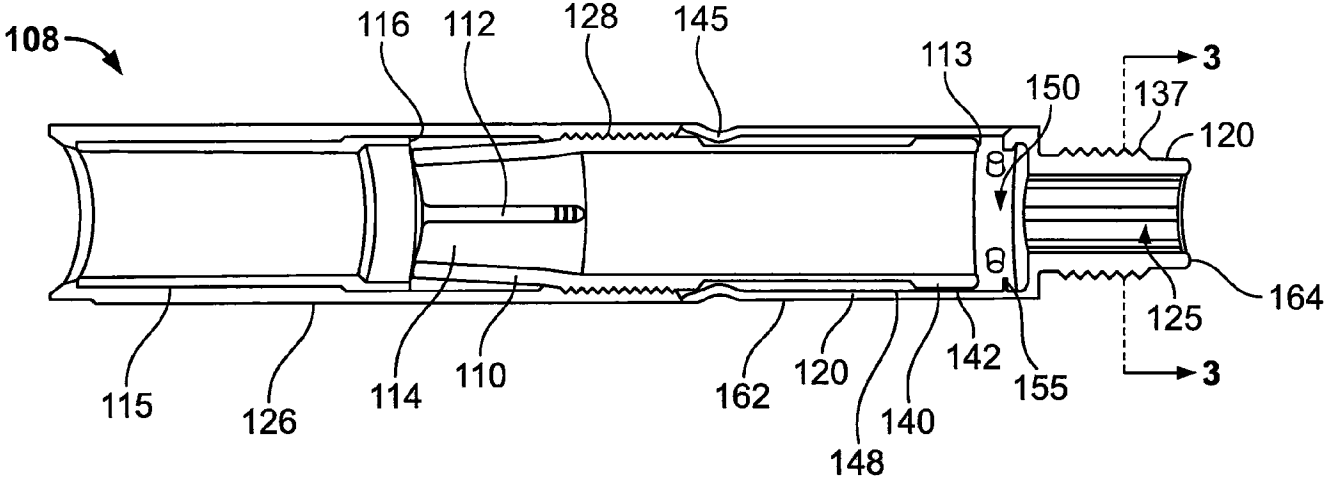
FIG. 1C is a side cross-sectional view of a contact assembly within the electrical connector of FIG. 1A.

The sleeve 105 receives the contact assembly 108, which includes all of the pieces of the electrical connector 100 that move axially during a fault close operation. The contact assembly 108 is designed to facilitate its removal from the connector 100 without having to remove the sleeve 105, as discussed below. Referring also to FIG. 1C, the contact assembly 108 includes a female contact 110 that is configured to be connected to a male contact of the contact connector, an arc snuffer 115 adjacent to the female contact 110, a contact holder 120, and a contact tube 126.

The female contact 110 is made of any conductive material, such as copper or aluminum. The female contact 110 is generally cylindrical and includes a piston region 140 at a first end that is intimately engaged to an inner surface of the contact holder 120 and a plurality of projecting contact fingers 114 extending from a second end. The contact fingers 114 are formed by providing a plurality of slots 112 azimuthally spaced around the outer end of female contact 110. The contact fingers 114 are shown in the contracted position in FIGS. 1A and 1C and are moved to the expanded position upon the insertion of a male contact of the contact connector, as described below. The piston region 140 includes a knurled surface 142 around its outer circumferential surface to provide a frictional, biting engagement between the cylindrical wall of the contact holder 120 and the female contact 110. This knurled surface 142 provides substantial friction and thus drag between the contact holder 120 and the female contact 110. The knurled surface 142 not only ensures good electrical contact between the contact holder 120 and the female contact 110, but also inhibits the reciprocation of the piston region 140 within a channel 148 of the contact holder 120 until such friction is overcome by gas pressure forces as described below. In particular, the piston region 140 moves relative to the contact holder 120 only if high pressure is present in the electrical connector 100, such as during a fault close operation. The piston region 140 is unitary with the female contact 110, such that the female contact also only moves under these pressure conditions.

Figure 3:
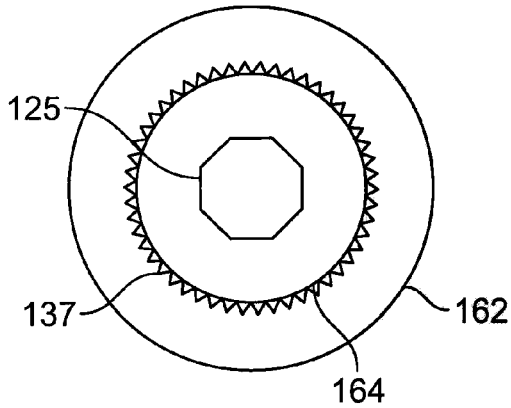
FIG. 3 is a cross-sectional view taken along line 3-3 of FIG. 1C.
Figure 4:
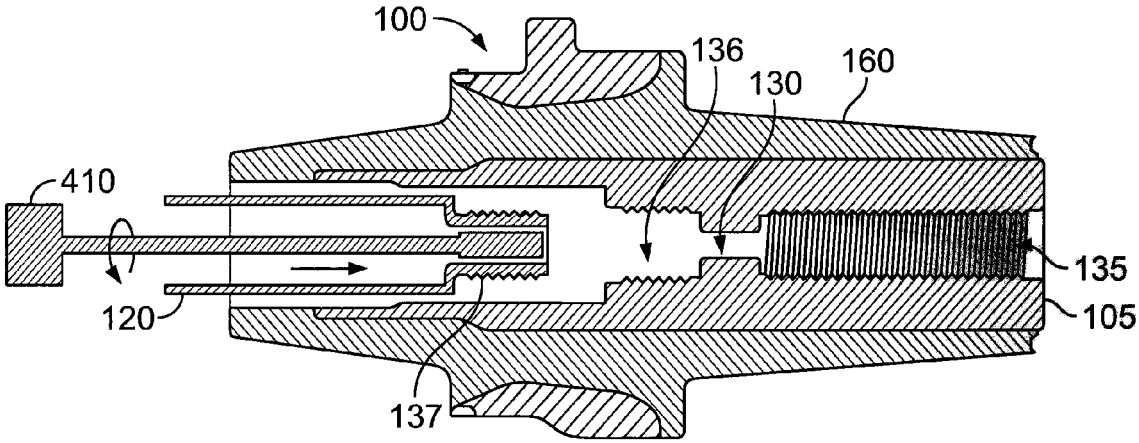
FIG. 4 is a cross-sectional view illustrating assembly of the electrical connector of FIG. 1A.

The contact holder 120 is made of a conductive material, such as copper. The contact holder 120 includes a cylindrical wall 162 that defines the channel 148 that receives the female contact 110. The wall 162 is shaped to form a piston stop 145 that protrudes into the channel 148 and has an inner diameter that is smaller than an outer diameter of the piston region 140. The contact holder 120 is intimately engaged to the sleeve 105 using, for example, threads 137 that mate with the threaded region 136 of the sleeve 105. The threads 137 are formed along an outer surface of a wall 164 that extends from the wall 162. The wall 164 also defines a torque-enabling feature 125 that opens into the channel 148. A hollow cavity 150 is formed within the channel 148 between the piston region 140 and the torque-enabling feature 125. The wall 162 may be formed with openings 155 within the hollow cavity 150. The openings 155 open to an exterior of the contact holder 120. Referring to FIGS. 3 and 4, the torque-enabling feature 125 has an octagonal cross section and receives an octagonally shaped torque device 410. In one implementation, the feature 125 is 0.45 inches in cross section.

The contact tube 126 abuts the contact holder 120 and is received within the elongated channel 138 of the sleeve 105. The contact tube 126 is made out of an insulating material such as fiberglass. The contact tube 126 is connected to the female contact 110 by, for example, threads 128 (as shown). The arc snuffer 115 is received within the contact tube 126 and is made from an arc-ablative plastic material. When an arc exists within the contact assembly, for example, during a fault close operation or a loadmake operation, a portion of the arc snuffer 115 vaporizes, which produces a gas that helps extinguish the arc.

The electrical connector 100 includes an insulating housing 160 that encapsulates and insulates the sleeve 105. The connector 100 also includes an insulating end piece 165 connected to an end of sleeve 105 with, for example, a snap fit, glue, an interference fit, or threads. The insulating end piece 165 has an inner diameter large enough to receive the contact tube 126. The housing 160 is made out of insulating rubber such as, for example, ethylene propylene diene monomer (EPDM). A conductive shell 170 surrounds a portion of the insulating housing 160. The conductive shell 170 may be made of a conductive elastomeric material, such as, for example, a terpolymer elastomer made from ethylene-propylene diene monomers loaded with carbon and/or other conductive materials. One example of a conductive material is ethylene propylene terpolymer (EPT) loaded with carbon. The insulating housing 160 is thickest in the area where the conductive shell 170 meets the insulated housing 160. In this way, the insulated housing 160 forms a dielectric and electrically insulative barrier between the high-voltage sleeve 105 and the conductive shell 170.

During assembly, the conductive shell 170 is first molded to fit around the insulating housing 160. Next, the end piece 165 is connected into the sleeve 105 by, for example, a snap fit. A steel molding support mandrel is inserted into the sleeve 105 and the connected end piece 165. Next, the conductive shell 170, the sleeve 105, and the connected end piece 165 are placed into an insulation fill mold. An insulating material then is injected into the fill mold to form the insulated housing 160. After the insulating material has set, the resulting molded housing 160, the shell 170, the sleeve 105, and the end piece 165 are removed from the fill mold and the steel molding support mandrel is removed from the sleeve 105 and the end piece 165. The contact tube 126 is then molded onto the arc snuffer 115, and the contact tube 126 and the arc snuffer 115 are connected to the female contact 110, using, for example, threads, a press fit, or glue. The female contact 110, the contact tube 126, and the arc snuffer 115 then are press-fit into the contact holder 120. Next, the piston stop 145 is crimped into the wall 162 of the contact holder 120. Finally, the contact assembly 108 is threaded into the sleeve 105 using the torque device 410, as illustrated in FIG. 4.

In use, during a fault closure, one of the electrical connector 100 and the contact connector is energized, and the other is engaged with a load having a fault, such as, for example, a short-circuit condition. Under such conditions, a substantial arcing occurs between a male contact of the contact connector and the female contact 110 as the male contact approaches the arc snuffer 115. In fault closure, the arc snuffer 115 generates substantial arc-quenching gases that produce a gas pressure within the cavity 150 that is sufficient to act upon a shoulder 116 of the arc snuffer 115 and a terminal end 113 of the female contact 110 and to overcome the frictional engagement of the knurled surface 142 with the inner wall 148. The arc-quenching gas pressure moves the entire contact assembly 108 (including the female contact 110, the arc snuffer 115, the contact holder 120, and the contact tube 126) toward the male contact of the contact connector to more quickly establish electrical contact between the male contact probe and the female contact 110. This accelerated electrical connection reduces the time required to make connection and thus reduces the possibility of explosion and any accompanying hazard to operating personnel during a fault close operation. Such a fault closure operation is described, for example, in U.S. Pat. No. 5,525,069, which is incorporated herein by reference.

Figure 5:
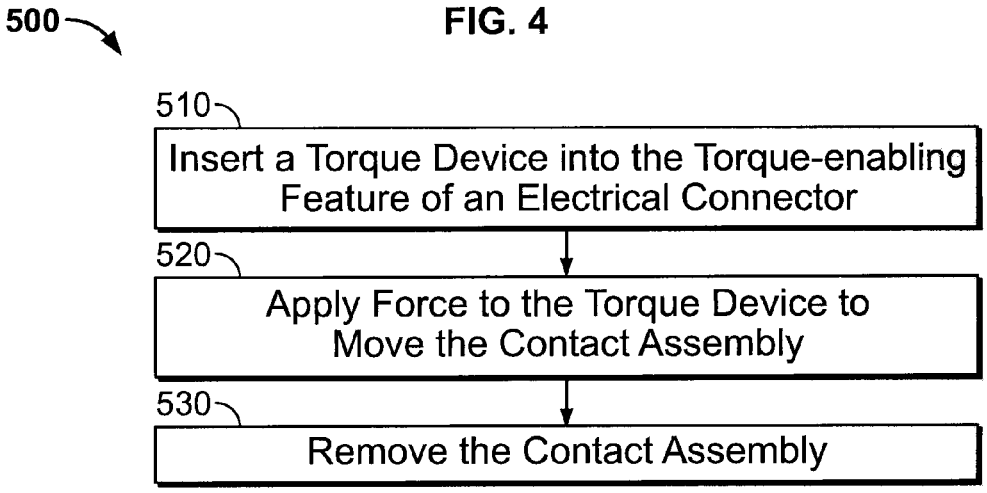
FIG. 5 illustrates a process for removing the contact assembly from the electrical connector of FIG. 1A.
Figure 6A:
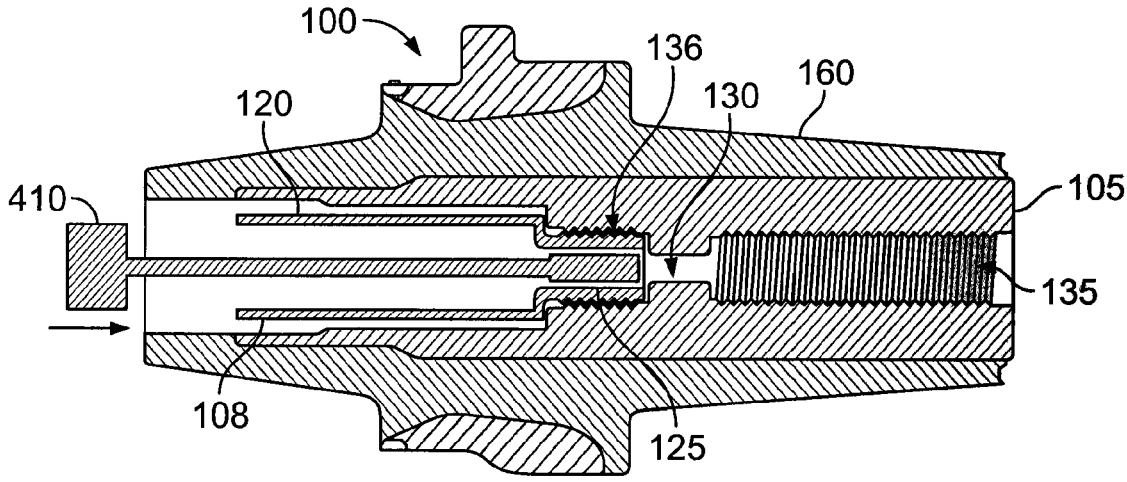
FIGS. 6A-6C illustrate the process for removing the contact assembly from the electrical connector of FIG. 1A.
Figure 6B:
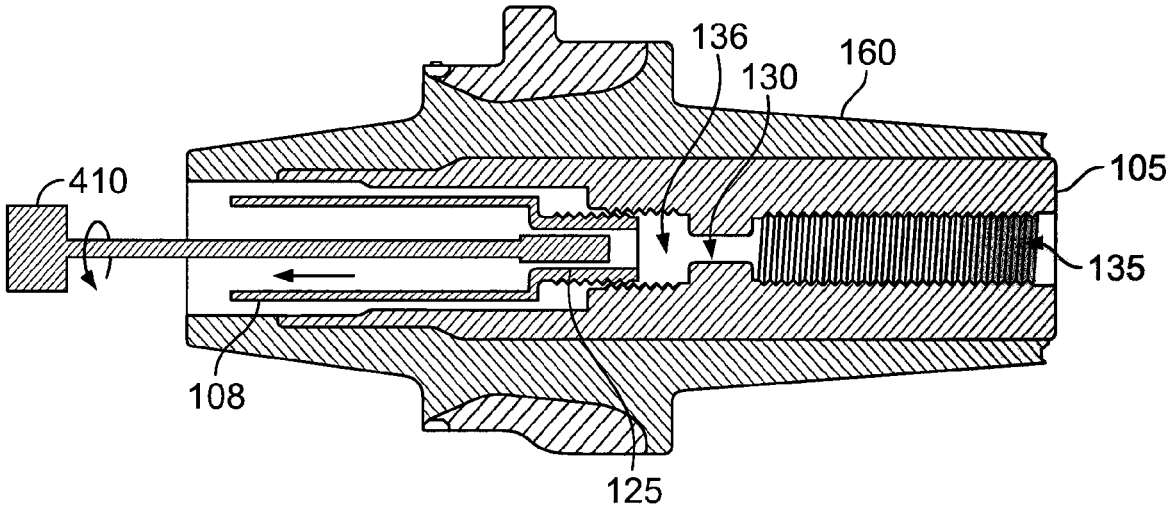
Figure 6C:
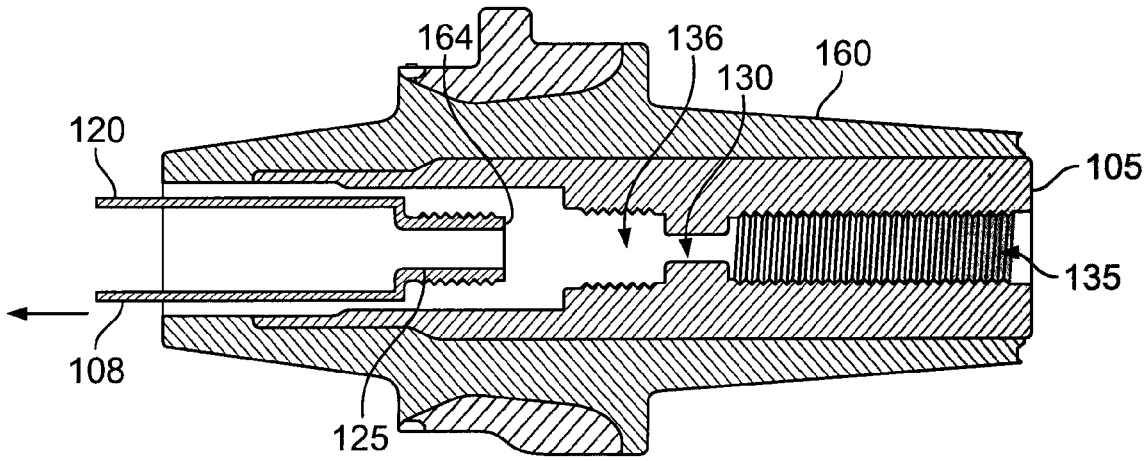

The contact assembly 108 is rendered unusable after such a fault operation, while other portions of the connector 100 are still usable. Thus, referring to FIG. 5, a procedure is performed to replace the contact assembly 108 of the connector 100 and to reuse the undamaged portions of electrical connector 100. Initially, as shown in FIG. 6A, a torque device 410 is inserted into the torque-enabling feature 125 (step 510). The torque device 410 may be anything that fits snugly into the torque-enabling feature 125, such as an allen wrench or a rod-like device having a shaft of the same cross-sectional shape as the torque-enabling feature 125. The user then applies a force to the torque device 410, which grabs the whole contact holder 120 and causes it to turn with the torque device 410 relative to the sleeve 105, thus moving the whole contact assembly 108 axially relative to the sleeve 105 as shown in FIG. 6B (step 520). After the threads 137 of the holder 120 are released from the threaded region 136 of the sleeve 105, the user can remove the contact assembly 108 from the sleeve 105, as shown in FIG. 6C (step 530). Once the user has removed the contact assembly 108 from the sleeve 105, she can insert and attach a new contact assembly.

Figure 7:
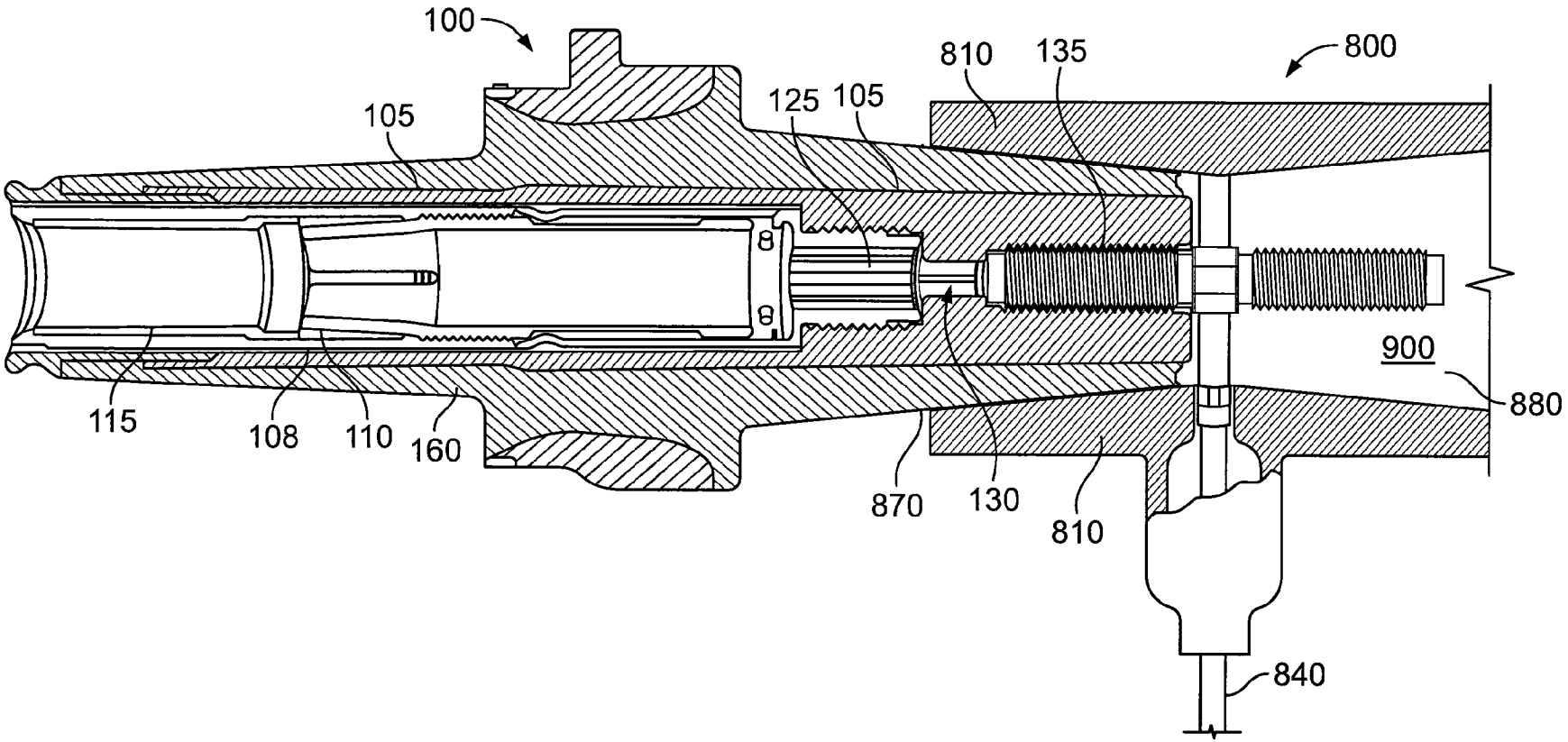
FIG. 7 illustrates the electrical connector of FIG. 1A inserted into a T-shaped cable connector.
Figure 8:
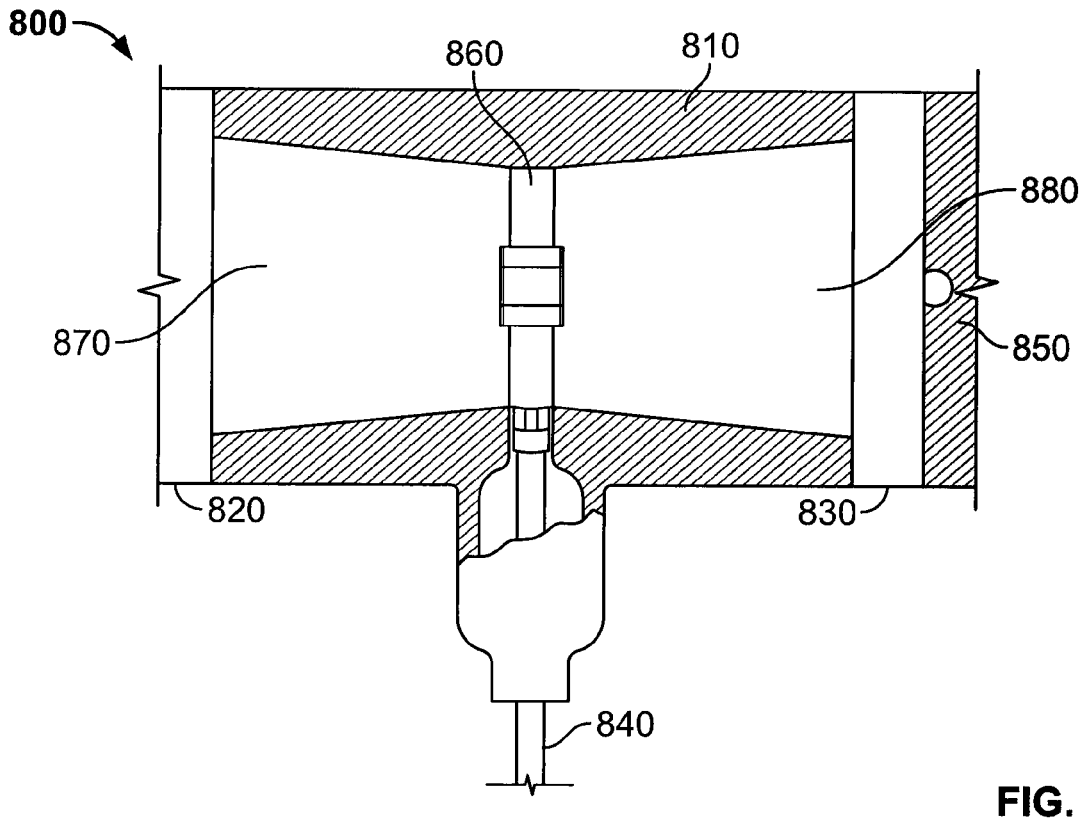
FIG. 8 is a cross-sectional view of the T-shaped cable connector of FIG. 7.
Figure 9:
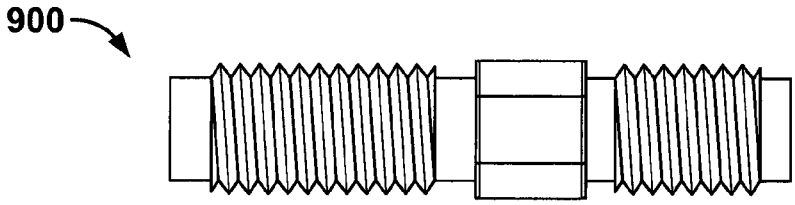
FIG. 9 is a side view of a threaded stud that is inserted into the T-shaped cable connector of FIG. 7.

Referring to FIG. 7, the electrical connector 100 is configured to connect to a T-shaped cable connector 800 at the first region 102. The connector 800 includes a housing 810 made from, for example, EPDM or another insulating rubber. Referring also to FIG. 8, the connector 800 includes an opening 820 that is sized to receive the electrical connector 100 and an opening 830 that connects to another electrical device or is closed off with an insulated plug cap 850 (as shown in FIG. 8). The connector 800 also includes a connective lug 860 that is connected to a cable 840 that extends into the housing 810. The housing 810 defines opposed, coaxial, tapered recesses 870 and 880 that flank the lug 860. The lug 860 receives a stud 900 (shown in FIG. 9) that, when inserted into the lug 860, protrudes into the recesses 870, 880 (as shown in FIG. 7).

Devices that are inserted into the recesses 870, 880 of the connector 800 through the openings 820, 830 connect to the stud 900 and thus to a cable 840, which is also electrically connected to the stud 900.

Figure 10:
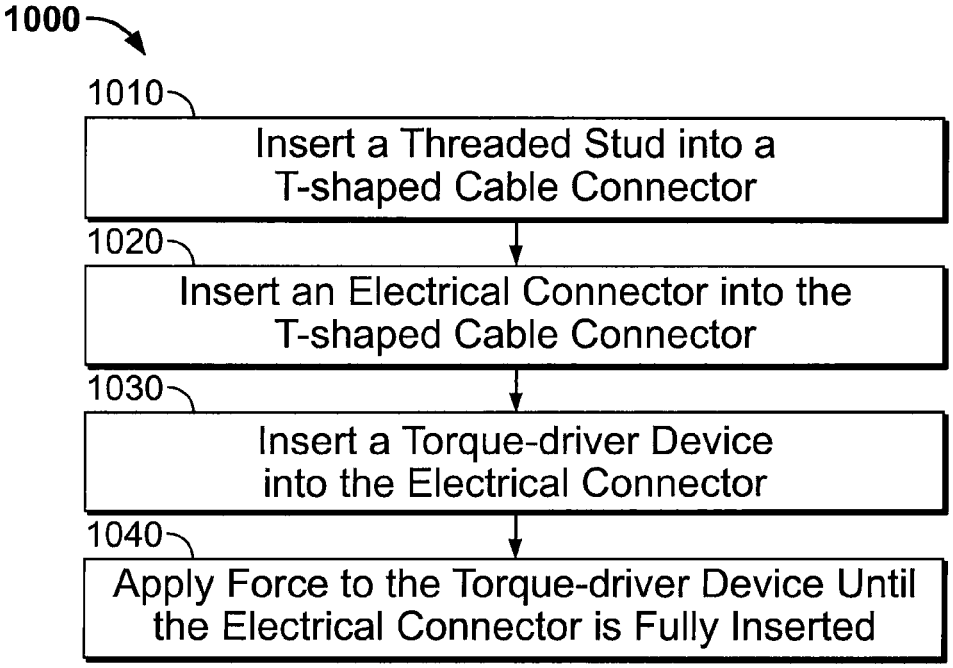
FIG. 10 is a process for connecting the electrical connector to the T-shaped cable connector of FIG. 7.
Figure 11A:
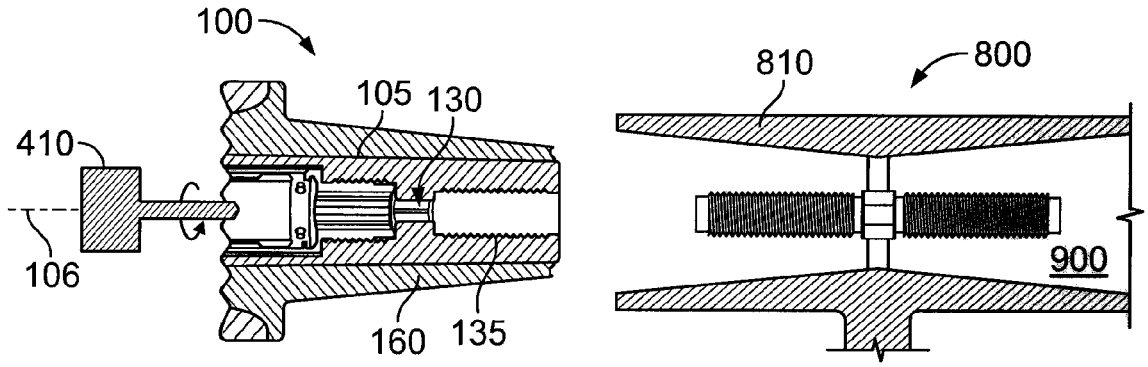
FIGS. 11A-11C illustrate insertion of the electrical connector into the T-shaped cable connector of FIG. 7.
Figure 11B:
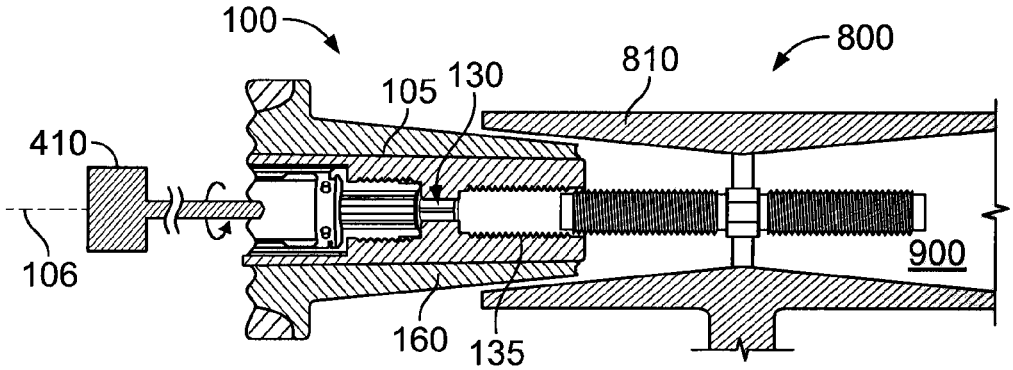
Figure 11C:
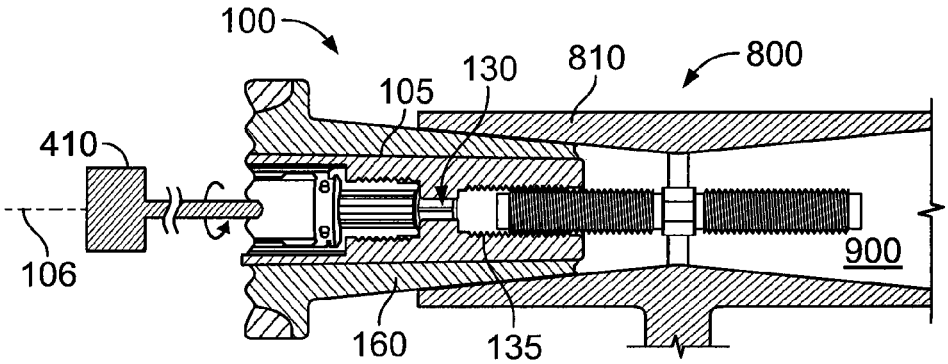

Referring to FIG. 10, a procedure 1000 is performed to connect the electrical connector 100 to the T-shaped connector 800. Initially, as shown in FIG. 11A, the threaded stud 900 is inserted into the lug 860 of the T-shaped connector 800 (step 1010). The threaded bore 135 of the electrical connector 100 is positioned relative to the threaded stud 900 of the T-shaped connector 800 to prepare to insert the electrical connector 100 into the T-shaped connector 800, as shown in FIG. 11A. The user then inserts electrical connector 100 into the T-shaped connector 800, as shown in FIG. 11B (step 1020). The threaded stud 900 is long such that its threads engage the threaded bore 135 before the housing 160 of the electrical connector 100 engages or contacts the housing 810 of the T-shaped connector 800, as shown in FIG. 11B. To insert the electrical connector 100, the user applies force to a torque device (not shown, but hang a shape that mates with the hexagonal shape of the opening 130) inserted into the torque-enabling opening 130 (step 1030). The force causes the electrical connector 100 to turn about the axis 106 defined by sleeve 105. As the user continues to apply force to the torque driver device, the threaded stud 900 moves more deeply into the threaded bore 135, as shown in FIG. 11C. The housing 160 of the electrical connector 100 now touches the housing 810 of T-shaped connector 800 at contact region 1110. Although there is friction between the insulated housings 160 and 810, the significant engagement of the threaded stud 900 and the threaded bore 135 allows further insertion of the connector 100 into the T-shaped connector 800. The user continues to apply force to the torque device until connector 100 is completely connected to the T-shaped connector 800, as shown in FIG. 10 (step 1040). After insertion is complete, the contact region 1110 extends continuously along the interface between the housing 160 of electrical connector 100 and the housing 810 of the T-shaped connector 800.

Other implementations are within the scope of the following claims. For example, the sleeve 105 may be made of multiple pieces. The contact tube 126 may be melted or glued onto the female contact 110.

The torque-enabling feature 125 and the torque-enabling opening 130 may have any cross section that can receive a torque device. For example, the torque-enabling features 125 or the torque-enabling opening 130 may have a cross section of any polygonal shape, or a polygonal shape having curved segments.

The piston region 140 may be formed separately from and then rigidly attached to the female contact 110.

The torque-enabling feature 125 may be formed along an outer surface of an end of the contact tube 126. For example, the outer surface of the end piece 165 can be a polygonal shape.

What is claimed is:

1. A method for connecting an electrical connector to a cable connector, the method comprising:

providing an electrical connector having a first insulating housing and a sleeve within the first insulating housing, the sleeve defining a threaded bore that is internal to the electrical connector and opens to an end of the electrical connector;

providing a cable connector having a second insulating housing;

providing a stud within the cable connector;

inserting the electrical connector into the cable connector such that threads formed on an outer surface of the stud directly engage threads of the threaded bore of the electrical connector before the first insulating housing of the electrical connector contacts the second insulating housing of the cable connector; and connecting the electrical connector to the cable connector by securing the stud to the threaded bore, in which the stud is secured to the threaded bore using a torque device that is inserted into a torque feature defined by the sleeve of the electrical connector and connected to the threaded bore of the electrical connector.

2. The method of claim 1, in which inserting includes inserting without the use of a coupling portion that extends from the sleeve of the electrical connector.

3. The method of claim 1, in which the cable connector is a T-shaped cable connector.

* * * * *